US005522497A

United States Patent [19]

Stacy

[11] Patent Number: 5,522,497

[45] Date of Patent: Jun. 4, 1996

[54] COMBINED TOOTHPASTE HOLDER AND VENTED TOOTHBRUSH CONTAINER

[76] Inventor: Nathan Stacy, 2400 Loraine Ave., Racine, Wis. 53404

[21] Appl. No.: 415,726

[22] Filed: Apr. 3, 1995

[51] Int. Cl.[6] ..... B65D 81/24

[52] U.S. Cl. ..... 206/209.100; 206/362.1

[58] Field of Search ..... 206/209.1, 362.1, 206/362.2, 361, 362, 581; 312/245, 209, 323, 206, 242; 4/638, 605, 559; 211/65, 66, 70.6, 60.1

[56] References Cited

U.S. PATENT DOCUMENTS

| | | | |
|---|---|---|---|
| 880,432 | 2/1908 | Weidhaas, Jr. | 206/209.1 |
| 1,298,041 | 3/1919 | Harris | 211/65 |
| 2,278,650 | 4/1942 | Drinkwater | 211/65 |
| 2,642,331 | 6/1953 | Sprinkle | 312/206 |
| 2,712,487 | 7/1955 | Miller | 312/206 |
| 3,881,868 | 5/1975 | Duke | 206/209.1 |
| 4,927,011 | 5/1990 | Wilkinson | 206/362.1 |

*Primary Examiner*—Thomas P. Hilliard
*Attorney, Agent, or Firm*—Kajane McManus

[57] ABSTRACT

The combined toothpaste holder and vented toothbrush container comprises a semi-cylindrical body, a flared base member, a hingedly engaged top and an insert which creates nested channels within the body. An inner channel includes a downwardly depending flange and engages a toothpaste tube while an outer channel is created within which toothbrush handles depend, the heads being held by the insert and the handles extending into openings therethrough.

10 Claims, 2 Drawing Sheets

COMBINED TOOTHPASTE HOLDER AND VENTED TOOTHBRUSH CONTAINER

BACKGROUND OF THE INVENTION

The present invention relates to an enclosed container which holds a tube of toothpaste therein together with a plurality of toothbrushes, the container being vented to allow the toothbrushes to air dry, and with structure being provided to eliminate potential water leakage therefrom to an underlying support surface.

PRIOR ART

Heretofore, various toothbrush holders and combination toothbrush and toothpaste holders have been proposed.

Examples of such devices may be found in the following U.S. Patents:

| U.S. Pat. No. | Patentee |
|---|---|
| 832,975 | Hyde |
| 1,298,041 | Harris |
| 2,608,294 | Ward |
| 2,642,331 | Sprinkle |
| Des. 144,535 | Beilock |
| Des. 171,029 | Coleman |
| Des. 182,197 | Olmstead |
| Des. 207,630 | Jones |
| Des. 312,182 | Ritchie |

These patents all disclose various embodiments of brush holders and the Ritchie patent discloses a combined toothbrush and toothpaste holder, wherein the brushes and paste are viewable by a user, with moisture from the brushes dripping onto a bottom flange and ultimately to the supporting surface therebeneath.

As will be described in greater detail hereinafter, the container of the present invention provides an aesthetic case within which brushes and paste can be stored out of view, with structure being provided to keep the supporting surface for the container dry and for ensuring accessibility to toothpaste tubes even when they are nearly empty.

SUMMARY OF THE INVENTION

According to the invention there is provided a combined toothpaste holder and vented toothbrush container comprising a hollow semi-cylindrical body, a base member engaged to an open bottom end of the body, a cover hingedly engaged to and over an open top end of the body and an insert engageable within and to the body, the insert creating nested channels in the body, an inner channel adapted to engage a toothpaste tube therein and an outer channel adapted to dependingly engage toothbrushes therein, the container including a plurality of air passages therein.

DESCRIPTION OF THE PREFERRED EMBODIMENT

Figure 1:
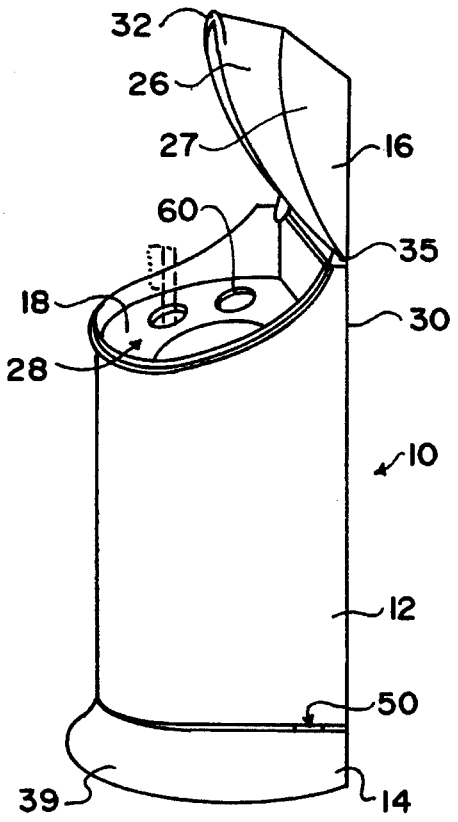
FIG. 1 is a perspective view of the combined toothpaste holder and toothbrush drying container of the present invention.
Figure 2:
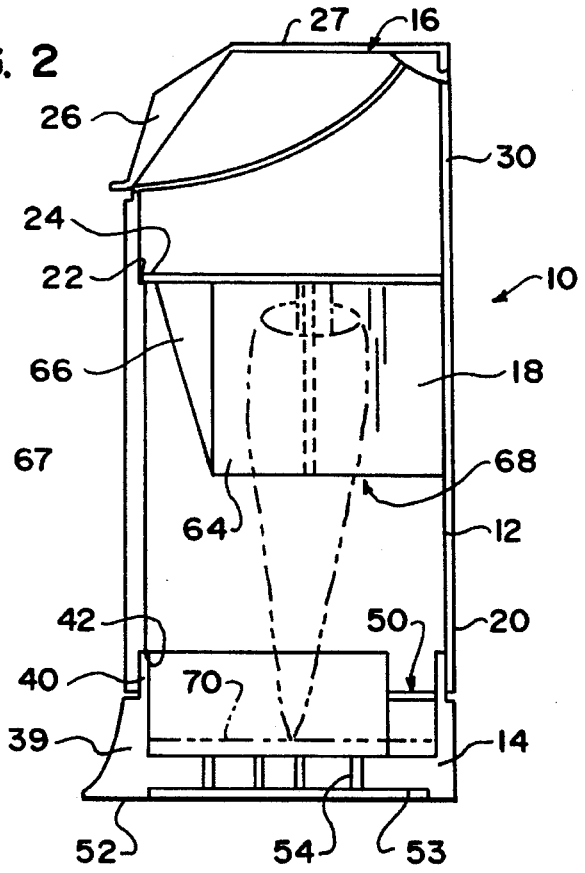
FIG. 2 is a cross sectional view through the container taken along line 2—2 of FIG. 1.
Figure 3:
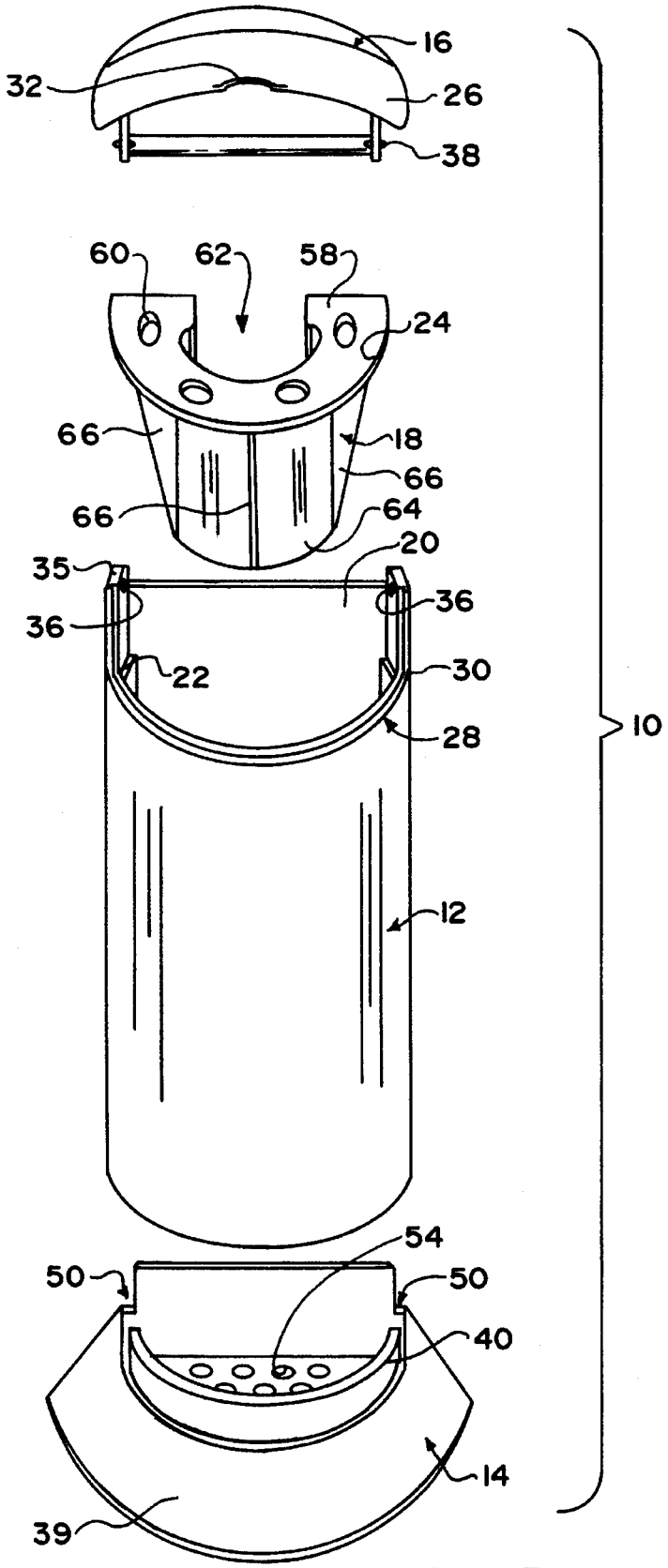
FIG. 3 is an exploded view showing the several components of the container.

Referring now to the drawings in greater detail there is illustrated therein the combined toothpaste tube and tooth brush drying container of the present invention generally identified by the reference numeral 10.

As shown the container 10 includes a housing body 12 which engages a removable base 14, a pivotally engaged lid 16, and an insert 18 which engages a toothpaste tube (shown in phantom) and a plurality of toothbrushes (one shown in phantom).

The housing 12 is designed so that it can be wall mounted (such as by attaching cooperating strips of Velcro®) to a flat back surface 20 thereof and to a supporting wall (not shown). Alternatively, the base 14 is configured to offer an unsupported free standing container 10 which can be placed upon a convenient underlying support surface (not shown) such as a bathroom sink.

In essence the container 10 has an elongate semicylindrical configuration, the length of the container 10 being sufficient to accommodate the length of items to be stored therewithin.

The housing body 12 has an inwardly stepped peripheral rib 22 created therein upon which a peripheral lip 24 of the insert 18 rests. The insert 18 is seated far enough below the cover 16 so that the cover 16 can be seated appropriately over toothbrush heads engaged therein.

The cover 16 is configured to be aesthetic in appearance and design, with a sidewall 26 thereof depending from a planar top surface 27 into an undercut area 28 created in an upper end 30 of the housing body 12 to ease access to the items therein.

If desired, a thumb tab 32 or other finger engaging structure may be provided to simplify opening of the cover 16.

The cover 16 is hingedly connected to the housing 12 along rear top tabs 35 of the housing 12 extending slightly forwardly of the back wall 20 thereof. The tabs each have a slot 36 into which a pin type hinge 38 of the cover 16 fits, allowing the cover 16 to pivot to a point slightly rearward of vertical so the cover 16 maintains itself open until closed.

It will be understood that the undercut area 28 in the housing 12 is sloped forwardly to cooperate with the forwardly sloped sidewall 26 of the cover 16, the cover 16 creating an aesthetic closed container 10 when closed.

Turning now to the base member 14 this base member 14 has been provided as a separate structure for ease in maintaining the interior of the container clean and has downwardly flared sidewall for 39 standing stability.

The base member 14 and housing body 12 are engaged by a friction fit type arrangement, with a top edge flange 40 created on the base member 14 and being slidably engageable within a peripheral bottom edge groove 42 of the housing body 12.

Toward the rear of the base member 14, an end section of the top edge flange 40 is eliminated bilaterally at 50, to create an air space between the housing body 12 and base member 14 to allow for air flow into the container 10.

This air space is effective in aiding drying of toothbrushes within the container 10 when the container 10 is placed upon an underlying support surface.

In this respect, a bottom surface 52 of the base member 14 has a recess 53 along a substantial portion of its extent, with a plurality of air ports 54 being created through the surface 52.

When the container 10 is wall mounted, air is provided to the interior of the container through the ports 54. On the other hand, when the container 10 is seated upon a support surface, air flow through the ports 54 is restricted, with the air spaces at 50 coming into play.

Turning now to the insert 18, it will first of all be seen to include a planar, somewhat C-shaped top surface 58 which extends inwardly from the lip 24 thereof and within which are provided a plurality of oval openings 60, each of which is configured to engage a toothbrush handle portion therein. It has been found that up to six toothbrushes may be adequately accommodated in the container 10.

The surface 58 is C-shaped to provide a center opening 62 therein which is sized to accommodate receipt of a toothpaste tube.

The center opening 62 is further defined by a circumferential downwardly depending flange 64. This flange 64 has been provided to maintain a partially empty tube of toothpaste upright even when it bows from weight of a full top end seated upon an empty bottom end.

A plurality of downwardly tapering radial supports 66 are provided between the flange 64 and the surface 58 of the insert 18 to provide lateral support for the flange 64.

When seated on the rib 22, the insert 18 creates nested channels, within an outer channel 67 of which toothbrush handles hang and within an inner channel 68 of which a toothpaste tube rests.

It will of course be understood that the opening 60 in the insert 18 are positioned so as not to overlie the underlying supports 66.

Also, if desired, a thin layer of air permeable material 70 such as sponge may line the interior of the base member 14 so that any water droplets are caught prior to dripping through the ports 54.

As described above, the container 10 has a number of advantages, some of which have been described above and others of which are inherent in the invention.

Also, modifications may be proposed to the container 10 without departing from the teachings herein. Accordingly, the scope of the invention is only to be limited as necessitated by the accompanying claims.

I claim:

1. A combined toothpaste holder and vented toothbrush container comprising a hollow semi-cylindrical body, a base member including a top edge flange which engages within a peripheral bottom edge groove in said body and which is engaged to an open bottom end of the body, a cover hingedly engaged to and over an open top end of the body and an insert engageable within and to the body, the insert creating nested channels in the body, an inner channel adapted to engage a toothpaste tube therein and an outer channel adapted to dependingly engage toothbrushes therein, the container including a plurality of air passages therein and said top edge flange of said base member being spaced from a planar rear wall of said base member at each end of said planar rear wall.

2. The container of claim 1 wherein said base member has a recessed bottom wall within which air passages are formed.

3. The container of claim 1 wherein said base member has a downwardly flared sidewall.

4. The container of claim 1 wherein said body has an undercut top surface area.

5. The container of claim 4 wherein said cover has a depending sidewall which fits snugly over said undercut top surface area of said body.

6. The container of claim 1 wherein said body has an inwardly extending rib along an upper area thereof.

7. The container of claim 6 wherein said insert has a planar top surface having a peripheral lip which is supported on said rib of said body.

8. The container of claim 7 wherein said planar top surface of said insert is letter C shaped and has a plurality of openings therein.

9. The container of claim 8 wherein said insert includes a depending flange positioned radially inwardly of said openings, the flange creating inner and outer nested channels in the body below the insert.

10. The container of claim 9 wherein a plurality of lateral supports are engaged between said top surface and said flange of said insert, within the outer nested channel, said supports being positioned so as not to underlie any openings in the top surface.

* * * * *